US010476170B2

(12) United States Patent
Rajagopalan et al.

(10) Patent No.: US 10,476,170 B2
(45) Date of Patent: Nov. 12, 2019

(54) ANTENNA ARRAYS HAVING CONDUCTIVE SHIELDING BUCKETS

(71) Applicant: Apple Inc., Cupertino, CA (US)

(72) Inventors: Harish Rajagopalan, San Jose, CA (US); Rodney A. Gomez Angulo, Santa Clara, CA (US); Simone Paulotto, Redwood City, CA (US); Matthew A. Mow, Los Altos, CA (US); Bilgehan Avser, Mountain View, CA (US); Hao Xu, Cupertino, CA (US); Jennifer M. Edwards, San Francisco, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/906,979

(22) Filed: Feb. 27, 2018

(65) Prior Publication Data

US 2019/0267718 A1 Aug. 29, 2019

(51) Int. Cl.

| | |
|---|---|
| ***H01Q 21/06*** | (2006.01) |
| ***H01Q 1/24*** | (2006.01) |
| ***H01Q 3/38*** | (2006.01) |
| ***H01Q 21/22*** | (2006.01) |
| *H01Q 1/42* | (2006.01) |

(52) U.S. Cl.

CPC ..... *H01Q 21/065* (2013.01); *H01Q 1/243* (2013.01); *H01Q 3/38* (2013.01); *H01Q 21/22* (2013.01); *H01Q 1/42* (2013.01)

(58) Field of Classification Search

CPC ..... H01Q 21/065; H01Q 21/22; H01Q 3/38; H01Q 1/243

USPC ..... 343/700 MS

See application file for complete search history.

(56) References Cited

U.S. PATENT DOCUMENTS

| | | | |
|---|---|---|---|
| 6,433,746 | B2 | 8/2002 | Kushihi et al. |
| 8,896,487 | B2 | 11/2014 | Chiang et al. |
| 9,041,619 | B2 | 5/2015 | McMilin et al. |

(Continued)

OTHER PUBLICATIONS

Siwen Yong et al., U.S. Appl. No. 15/707,721, filed Sep. 18, 2017.

(Continued)

*Primary Examiner* — Brian K Young

(74) *Attorney, Agent, or Firm* — Treyz Law Group, P.C.; Michael H. Lyons

(57) ABSTRACT

An electronic device may be provided with a sidewall, a display module separated from the sidewall by a gap, a display cover, a conductive bucket mounted to the display cover within the gap, and a phased antenna array mounted to the bucket for conveying millimeter wave signals through the display cover. The sidewall may form part of an antenna for conveying non-millimeter wave signals. The array may include resonating elements on a substrate. The resonating elements may be fed using feed terminals coupled to alternating sides of the resonating elements. Dielectric layers having a dielectric constant lower than that of the display cover may be provided on a surface of the display cover within the bucket. The array may operate with satisfactory efficiency despite the small amount of available space within the device, electromagnetic interference from the sidewall and the display module, and dielectric loading by the display cover.

20 Claims, 12 Drawing Sheets

(56) References Cited

U.S. PATENT DOCUMENTS

| | | | | |
|---|---|---|---|---|
| 9,276,322 | B2 * | 3/2016 | Ban | H01Q 13/106 |
| 9,667,290 | B2 | 5/2017 | Ouyang et al. | |
| 9,882,282 | B2 | 1/2018 | Noori et al. | |
| 9,883,452 | B2 * | 1/2018 | Sela | H04B 1/3838 |
| 9,935,360 | B2 * | 4/2018 | Mai | H01Q 1/243 |
| 10,205,224 | B2 * | 2/2019 | Mow | H01Q 1/243 |
| 2005/0079903 | A1 | 4/2005 | Taketomi et al. | |
| 2018/0090816 | A1 | 3/2018 | Mow et al. | |

OTHER PUBLICATIONS

Siwen Yong et al., U.S. Appl. No. 15/710,361, filed Sep. 20, 2017.
Pietro Romano et al., U.S. Appl. No. 15/717,821, filed Sep. 27, 2017.
Jiangfeng Wu et al., U.S. Appl. No. 15/717,701, filed Sep. 27, 2017.
Basim Noori et al., U.S. Appl. No. 15/655,727, filed Jul. 20, 2017.

* cited by examiner

ANTENNA ARRAYS HAVING CONDUCTIVE SHIELDING BUCKETS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums. In addition, antennas that support millimeter wave and centimeter wave communications are often particularly susceptible to electromagnetic interference from nearby electronic components.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antennas may be arranged in a phased antenna array.

The electronic device may include a housing having a peripheral conductive sidewall. The electronic device may include a display having a display cover layer mounted to the peripheral conductive sidewall and a display module that emits light through the display cover layer. The display module may be separated from the peripheral conductive sidewall by a gap. A conductive bucket may be mounted to the display cover layer within the gap. The conductive bucket and the display cover layer may define an enclosed cavity. The conductive bucket may include a conductive rear wall and conductive sidewalls that extend from a periphery of the conductive rear wall to an inner surface of the display cover layer. A phased antenna array may be mounted to the conductive rear wall within the cavity. The phased antenna array may transmit radio-frequency signals at frequencies greater than 10 GHz through the display cover layer. The peripheral conductive sidewall may form part of an antenna that handles radio-frequency signals below 10 GHz. The conductive bucket may shield the phased antenna array from interference by the peripheral conductive sidewall and/or the display module.

If desired, the phased antenna array may include antenna resonating elements on a dielectric substrate. The antenna resonating elements may each be coupled to first and second antenna feeds for covering vertical and horizontal polarizations. If desired, the antenna resonating elements may include additional feeds for covering the vertical and horizontal polarizations. In this scenario, switching circuitry may be used to activate a selected one of the antenna feeds for covering horizontal and/or vertical polarizations on each antenna resonating element at any given time. In one suitable arrangement, antenna feeds for covering the same polarization may be located on alternating sides of the antenna resonating elements within the phased antenna array to mitigate cross-coupling between the antennas. If desired, one or more dielectric layers having a dielectric constant that is lower than the dielectric constant of the display cover layer may be provided on an interior surface of the display cover layer within the cavity. The phased antenna array may operate with satisfactory antenna efficiency at millimeter and centimeter wave frequencies despite the small amount of available space within the electronic device, electromagnetic interference generated by the peripheral conductive housing sidewall and the display module, and/or dielectric loading effects from the display cover layer.

DETAILED DESCRIPTION

Figure 1:
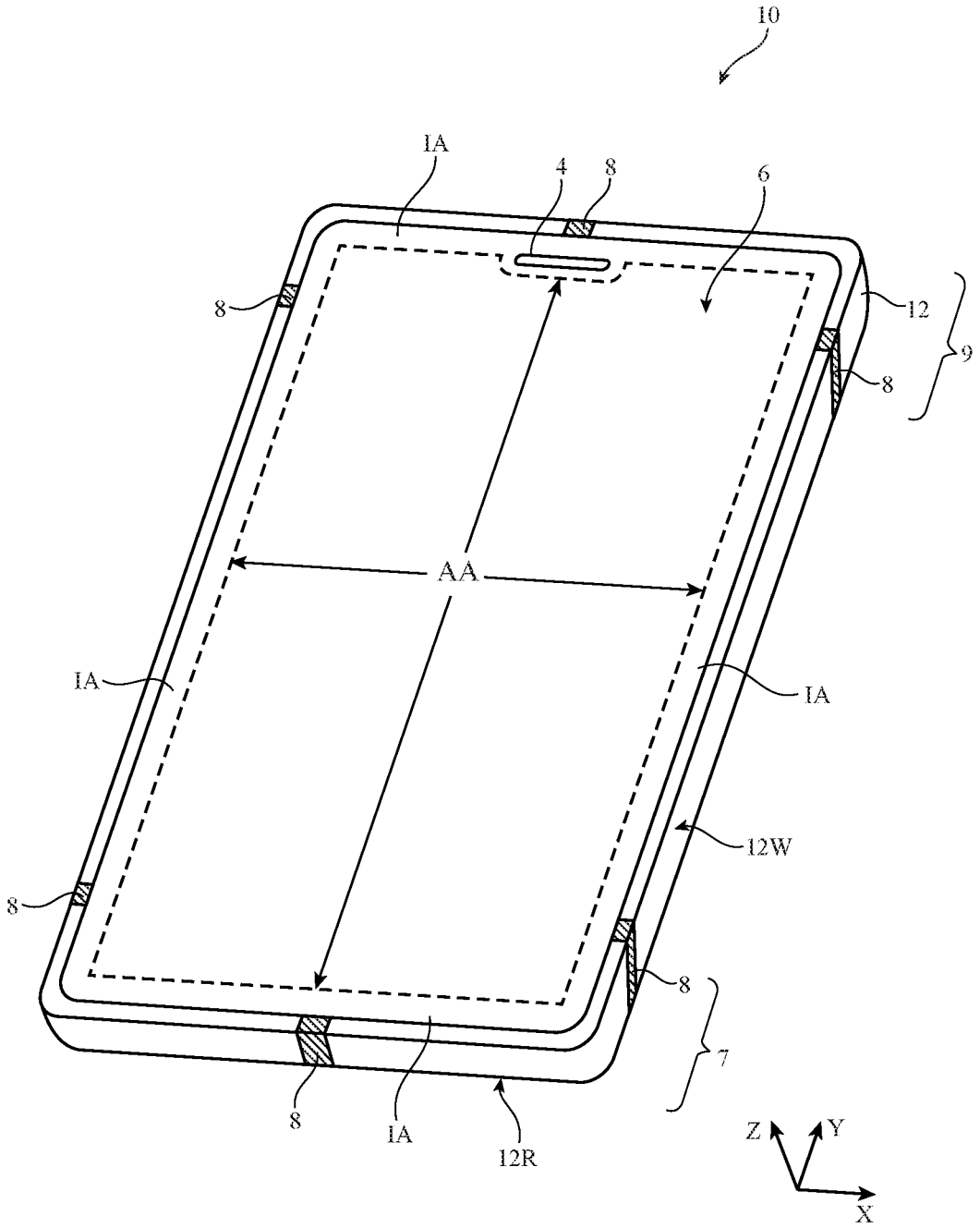
FIG. 1 is a perspective view of an illustrative electronic device in accordance with an embodiment.

Electronic devices such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. While uses of millimeter wave communications may be described herein as examples, centimeter wave communications, EHF communications, or any other types of communications may be similarly used. If desired, electronic devices may also contain wireless communications circuitry for handling satellite navigation system signals, cellular telephone signals, local wireless area network signals, near-field communications, light-based wireless communications, or other wireless communications.

Electronic devices (such as device 10 in FIG. 1) may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station (e.g., a wireless router or other equipment for routing communications between other wireless devices and a larger network such as the internet or a cellular telephone network), a desktop computer, a keyboard, a gaming controller, a computer mouse, a mousepad, a trackpad or touchpad, equipment that implements the functionality of two or more of these devices, or other electronic equipment. The above-mentioned examples are merely illustrative. Other configurations may be used for electronic devices if desired.

As shown in FIG. 1, device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 6. Display 6 may be mounted on the front face of device 10. Display 6 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and rear housing wall 12R may sometimes be referred to herein collectively as conductive structures of housing 12. Peripheral structures 12W may run around the periphery of device 10 and display 6. In configurations in which device 10 and display 6 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 6 (e.g., a cosmetic trim that surrounds all four sides of display 6 and/or that helps hold display 6 to 4; device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 6 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 6), peripheral conductive housing structures 12W may run around the lip of housing 12 (i.e., peripheral conductive housing structures 12W may cover only the edge of housing 12 that surrounds display 6 and not the rest of the sidewalls of housing 12).

If desired, rear housing wall 12R may be formed from a metal such as stainless steel or aluminum and may sometimes be referred to herein as conductive rear housing wall 12R or conductive rear wall 12R. Conductive rear housing wall 12R may lie in a plane that is parallel to display 6. In configurations for device 10 in which rear housing wall 12R is formed from metal, it may be desirable to form parts of peripheral conductive housing structures 12W as integral portions of the housing structures forming the conductive rear housing wall of housing 12. For example, conductive rear housing wall 12R of device 10 may be formed from a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Conductive rear housing wall 12R may have one or more, two or more, or three or more portions. Peripheral conductive housing structures 12W and/or the conductive rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 12W and/or 12R from view of the user).

Display 6 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 6 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 6 that overlaps inactive area IA may be coated with an opaque masking layer in inactive area IA. The opaque masking layer may have any suitable color.

Display 6 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 4 or a microphone port. Openings may be formed in housing 12 to form communications ports (e.g., an audio jack port, a digital data port, etc.) and/or audio ports for audio components such as a speaker and/or a microphone if desired.

Display 6 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of sidewalls 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 6, for example.

In regions 7 and 9, openings may be formed within the conductive structures of device 10 (e.g., between peripheral conductive housing structures 12W and opposing conductive ground structures such as conductive portions of conductive rear housing wall 12R, conductive traces on a printed circuit board, conductive electrical components in display 6, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 7 and 9 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 7 and 9. If desired, the ground plane that is under active area AA of display 6 and/or other metal structures in device 10 may have portions that extend into parts of the ends of device 10 (e.g., the ground may extend towards the dielectric-filled openings in regions 7 and 9), thereby narrowing the slots in regions 7 and 9.

In general, device 10 may include any suitable number of antennas (e.g., one or more, two or more, three or more, four or more, etc.). The antennas in device 10 may be located at opposing first and second ends of an elongated device housing (e.g., at ends 7 and 9 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 8, as shown in FIG. 1. The gaps in peripheral conductive housing structures 12W may be filled with dielectric such as polymer, ceramic, glass, air, other dielectric materials, or combinations of these materials. Gaps 8 may divide peripheral conductive housing structures 12W into one or more peripheral conductive segments. There may be, for example, two peripheral conductive segments in peripheral conductive housing structures 12W (e.g., in an arrangement with two of gaps 8), three peripheral conductive segments (e.g., in an arrangement with three of gaps 8), four peripheral conductive segments (e.g., in an arrangement with four of gaps 8), six peripheral conductive segments (e.g., in an arrangement with six gaps 8), etc. The segments of peripheral conductive housing structures 12W that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 8, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 9. A lower antenna may, for example, be formed at the lower end of device 10 in region 7. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc. Peripheral conductive housing structures 12W and/or conductive rear housing wall 12R may be used to form antenna resonating elements (e.g., inverted-F antenna resonating element arms, edges of slot antenna resonating elements, etc.) for antennas in device 10 that cover frequencies below 10 GHz (e.g., cellular telephone frequencies, wireless local and personal area network frequencies, satellite navigation frequencies, near field communications frequencies, etc.). Other antennas in device 10 may be used to support communications in millimeter wave or centimeter wave communications bands above 10 GHz (sometimes referred to herein as millimeter and centimeter wave communications antennas).

In order to provide an end user of device 10 with as large of a display as possible (e.g., to maximize an area of the device used for displaying media, running applications, etc.), it may be desirable to increase the amount of area at the front face of device 10 that is covered by active area AA of display 6. Increasing the size of active area AA may reduce the size of inactive area IA within device 10. This may reduce the area within device 10 available for forming millimeter and centimeter wave communications antennas within device 10.

Millimeter and centimeter wave communications antennas may be particularly susceptible to electromagnetic interference and coupling from nearby electronic components (e.g., active components such as active area AA of display 6 and components used in forming other antennas in device 10 such as peripheral conductive housing structures 12W, particularly in scenarios where peripheral conductive housing structures 12W are used to form antenna resonating elements for other antennas that cover frequencies lower than 10 GHz such as cellular telephone frequencies). If care is not taken, increasing the size of active area AA may reduce the operating space available to the millimeter and centimeter wave communications antennas, which can in turn increase the amount of electromagnetic interference imposed on the millimeter and centimeter wave communications antennas by active area AA and peripheral conductive housing structures 12W. It would therefore be desirable to be able to provide millimeter and centimeter wave communications antennas that are free from interference from other components in device 10 despite the limited area available within device 10.

Figure 2:
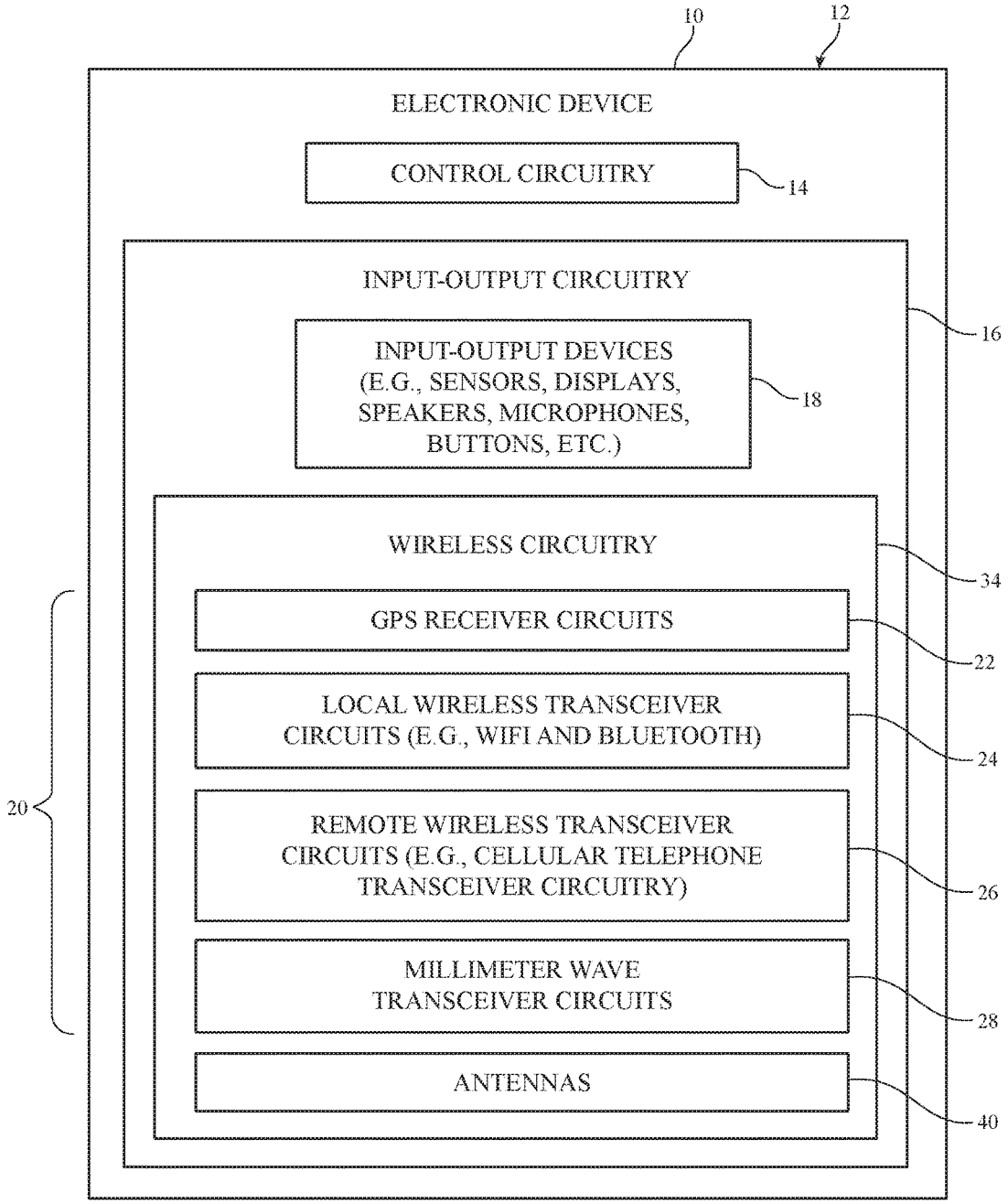
FIG. 2 is a schematic diagram of an illustrative electronic device with wireless communications circuitry in accordance with an embodiment.

FIG. 2 is a schematic diagram showing illustrative components that may be used in an electronic device such as electronic device 10. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other wireless personal area network protocols, IEEE 802.1 lad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 20 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for Wi-Fi® (IEEE 802.11) communications or other wireless local area network (WLAN) bands and may handle the 2.4 GHz Bluetooth® communications band or other wireless personal area network (WPAN) bands.

Circuitry 34 may use cellular telephone transceiver circuitry 26 for handling wireless communications in frequency ranges such as a low communications band from 600 to 960 MHz, a midband from 1710 to 2170 MHz, a high band from 2300 to 2700 MHz, an ultra-high band from 3400 to 3700 MHz, or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a Ku communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.1 lad communications at 60 GHz and/or 5th generation mobile networks or 5th generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., transceiver circuitry 28 may transmit and receive radio-frequency signals in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In Wi-Fi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals that travel (over short distances) between a transmitter and a receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, stacked patch antenna structures, antenna structures having parasitic elements, inverted-F antenna structures, slot antenna structures, planar inverted-F antenna structures, monopoles, dipoles, helical antenna structures, Yagi (Yagi-Uda) antenna structures, surface integrated waveguide structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can be arranged in phased antenna arrays for handling millimeter wave and centimeter wave communications.

Transmission line paths may be used to route antenna signals within device 10. For example, transmission line paths may be used to couple antennas 40 to transceiver circuitry 20. Transmission line paths in device 10 may include coaxial cable paths, microstrip transmission lines, stripline transmission lines, edge-coupled microstrip transmission lines, edge-coupled stripline transmission lines, waveguide structures for conveying signals at millimeter wave frequencies (e.g., coplanar waveguides or grounded coplanar waveguides), transmission lines formed from combinations of transmission lines of these types, etc.

Transmission line paths in device 10 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40 if desired.

In some configurations, antennas 40 may include antenna arrays (e.g., phased antenna arrays to implement beam steering functions). For example, the antennas that are used in handling millimeter wave signals for extremely high frequency wireless transceiver circuits 28 may be implemented as phased antenna arrays. The radiating elements in a phased antenna array for supporting millimeter wave communications may be patch antennas, dipole antennas, Yagi (Yagi-Uda) antennas, or other suitable antenna elements. Transceiver circuitry 28 can be integrated with the phased antenna arrays to form integrated phased antenna array and transceiver circuit modules or packages (sometimes referred to herein as integrated antenna modules or antenna modules) if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased antenna arrays into device 10, each of which is placed in a different location within or on device 10. With this type of arrangement, an unblocked phased antenna array may be switched into use and, once switched into use, the phased antenna array may use beam steering to optimize wireless performance. Similarly, if a phased antenna array does not face or have a line of sight to an external device, another phased antenna array that has line of sight to the external device may be switched into use and that phased antenna array may use beam steering to optimize wireless performance. Configurations in which antennas from one or more different locations in device 10 are operated together may also be used (e.g., to form a phased antenna array, etc.).

Figure 3:
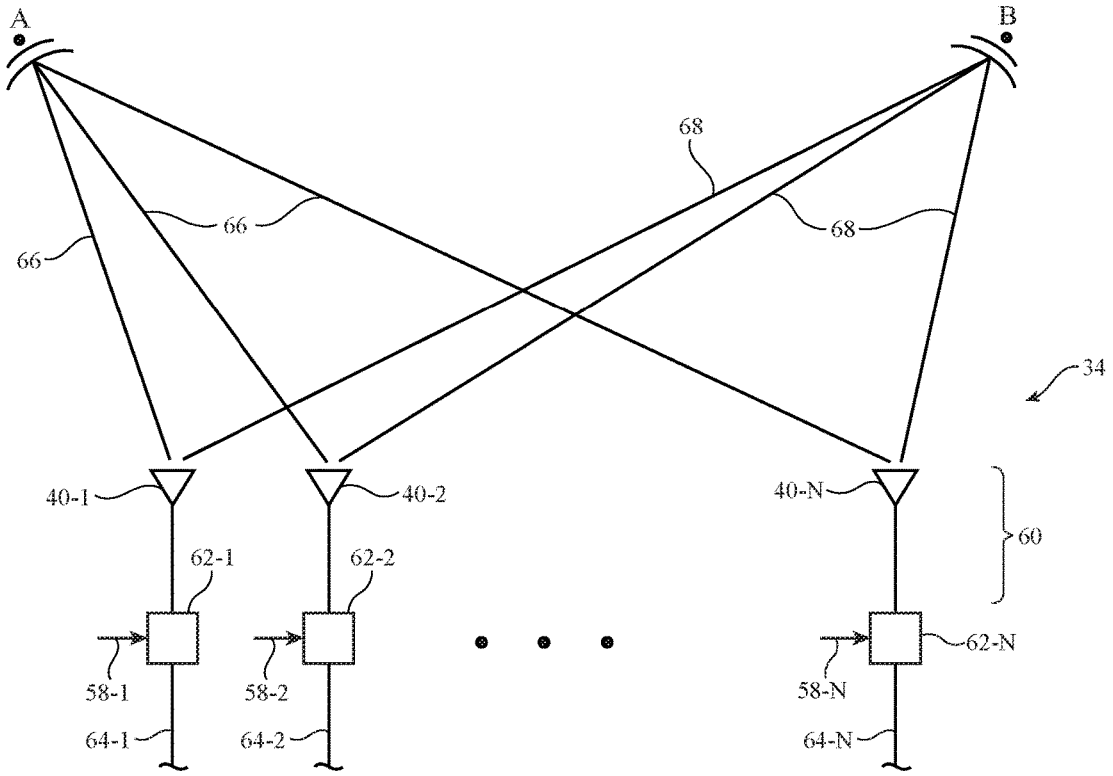
FIG. 3 is a diagram of an illustrative phased antenna array that may be adjusted using control circuitry to direct a beam of signals in accordance with an embodiment.

FIG. 3 shows how antennas 40 for handling millimeter and centimeter wave communications may be formed in a phased antenna array. As shown in FIG. 3, phased antenna array 60 (sometimes referred to herein as array 60, antenna array 60, or array 60 of antennas 40) may be coupled to signal paths such as transmission line paths 64 (e.g., one or more radio-frequency transmission lines). For example, a first antenna 40-1 in phased antenna array 60 may be coupled to a first transmission line path 64-1, a second antenna 40-2 in phased antenna array 60 may be coupled to a second transmission line path 64-2, an Nth antenna 40-N in phased antenna array 60 may be coupled to an Nth transmission line path 64-N, etc. While antennas 40 are described herein as forming a phased antenna array, the antennas 40 in phased antenna array 60 may sometimes be referred to as collectively forming a single phased array antenna.

Antennas 40 in phased antenna array 60 may be arranged in any desired number of rows and columns or in any other desired pattern (e.g., the antennas need not be arranged in a grid pattern having rows and columns). During signal transmission operations, transmission line paths 64 may be used to supply signals (e.g., radio-frequency signals such as millimeter wave and/or centimeter wave signals) from transceiver circuitry 28 (FIG. 2) to phased antenna array 60 for wireless transmission to external wireless equipment. During signal reception operations, transmission line paths 64 may be used to convey signals received at phased antenna array 60 from external equipment to transceiver circuitry 28 (FIG. 2).

The use of multiple antennas 40 in phased antenna array 60 allows beam steering arrangements to be implemented by controlling the relative phases and magnitudes (amplitudes) of the radio-frequency signals conveyed by the antennas. In the example of FIG. 3, antennas 40 each have a corresponding radio-frequency phase and magnitude controller 62 (e.g., a first phase and magnitude controller 62-1 interposed on transmission line path 64-1 may control phase and magnitude for radio-frequency signals handled by antenna 40-1, a second phase and magnitude controller 62-2 interposed on transmission line path 64-2 may control phase and magnitude for radio-frequency signals handled by antenna 40-2, an Nth phase and magnitude controller 62-N interposed on transmission line path 64-N may control phase and magnitude for radio-frequency signals handled by antenna 40-N, etc.).

Phase and magnitude controllers 62 may each include circuitry for adjusting the phase of the radio-frequency signals on transmission line paths 64 (e.g., phase shifter circuits) and/or circuitry for adjusting the magnitude of the radio-frequency signals on transmission line paths 64 (e.g., power amplifier and/or low noise amplifier circuits). Phase and magnitude controllers 62 may sometimes be referred to collectively herein as beam steering circuitry (e.g., beam steering circuitry that steers the beam of radio-frequency signals transmitted and/or received by phased antenna array 60).

Phase and magnitude controllers 62 may adjust the relative phases and/or magnitudes of the transmitted signals that are provided to each of the antennas in phased antenna array 60 and may adjust the relative phases and/or magnitudes of the received signals that are received by phased antenna array 60 from external equipment. Phase and magnitude controllers 62 may, if desired, include phase detection circuitry for detecting the phases of the received signals that are received by phased antenna array 60 from external equipment. The term "beam" or "signal beam" may be used herein to collectively refer to wireless signals that are transmitted and received by phased antenna array 60 in a particular direction. The term "transmit beam" may sometimes be used herein to refer to wireless radio-frequency signals that are transmitted in a particular direction whereas the term "receive beam" may sometimes be used herein to refer to wireless radio-frequency signals that are received from a particular direction.

If, for example, phase and magnitude controllers 62 are adjusted to produce a first set of phases and/or magnitudes for transmitted millimeter wave signals, the transmitted signals will form a millimeter wave frequency transmit beam as shown by beam 66 of FIG. 3 that is oriented in the direction of point A. If, however, phase and magnitude controllers 62 are adjusted to produce a second set of phases and/or magnitudes for the transmitted millimeter wave signals, the transmitted signals will form a millimeter wave frequency transmit beam as shown by beam 68 that is oriented in the direction of point B. Similarly, if phase and magnitude controllers 62 are adjusted to produce the first set of phases and/or magnitudes, wireless signals (e.g., millimeter wave signals in a millimeter wave frequency receive beam) may be received from the direction of point A as shown by beam 66. If phase and magnitude controllers 62 are adjusted to produce the second set of phases and/or magnitudes, signals may be received from the direction of point B, as shown by beam 68.

Each phase and magnitude controller 62 may be controlled to produce a desired phase and/or magnitude based on a corresponding control signal 58 received from control circuitry 14 of FIG. 2 or other control circuitry in device 10 (e.g., the phase and/or magnitude provided by phase and magnitude controller 62-1 may be controlled using control signal 58-1, the phase and/or magnitude provided by phase and magnitude controller 62-2 may be controlled using control signal 58-2, etc.). If desired, control circuitry 14 may actively adjust control signals 58 in real time to steer the transmit or receive beam in different desired directions over time. Phase and magnitude controllers 62 may provide information identifying the phase of received signals to control circuitry 14 if desired.

When performing millimeter or centimeter wave communications, radio-frequency signals are conveyed over a line of sight path between phased antenna array 60 and external equipment. If the external equipment is located at location A of FIG. 3, phase and magnitude controllers 62 may be adjusted to steer the signal beam towards direction A. If the external equipment is located at location B, phase and magnitude controllers 62 may be adjusted to steer the signal beam towards direction B. In the example of FIG. 3, beam steering is shown as being performed over a single degree of freedom for the sake of simplicity (e.g., towards the left and right on the page of FIG. 3). However, in practice, the beam is steered over two or more degrees of freedom (e.g., in three dimensions, into and out of the page and to the left and right on the page of FIG. 3).

Figure 4:
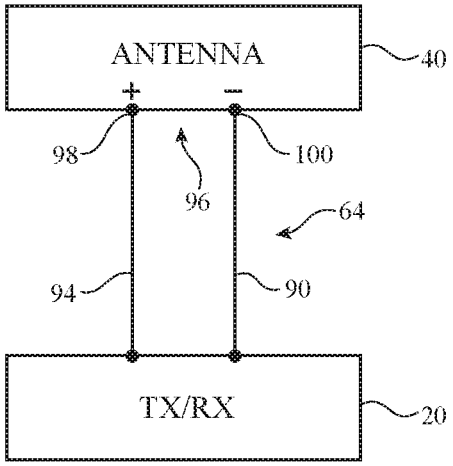
FIG. 4 is a schematic diagram of illustrative wireless communications circuitry in accordance with an embodiment.

A schematic diagram of an antenna 40 that may be formed in phased antenna array 60 (e.g., as antenna 40-1, 40-2, 40-3, and/or 40-N in phased antenna array 60 of FIG. 3) is shown in FIG. 4. As shown in FIG. 4, antenna 40 may be coupled to transceiver circuitry 20 (e.g., millimeter wave transceiver circuitry 28 of FIG. 2). Transceiver circuitry 20 may be coupled to antenna feed 96 of antenna 40 using transmission line path 64 (sometimes referred to herein as radio-frequency transmission line 64). Antenna feed 96 may include a positive antenna feed terminal such as positive antenna feed terminal 98 and may include a ground antenna feed terminal such as ground antenna feed terminal 100. Transmission line path 64 may include a positive signal conductor such as signal conductor 94 that is coupled to terminal 98 and a ground conductor such as ground conductor 90 that is coupled to terminal 100.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas. An illustrative patch antenna that may be used in phased antenna array 60 of FIG. 3 is shown in FIG. 5.

Figure 5:
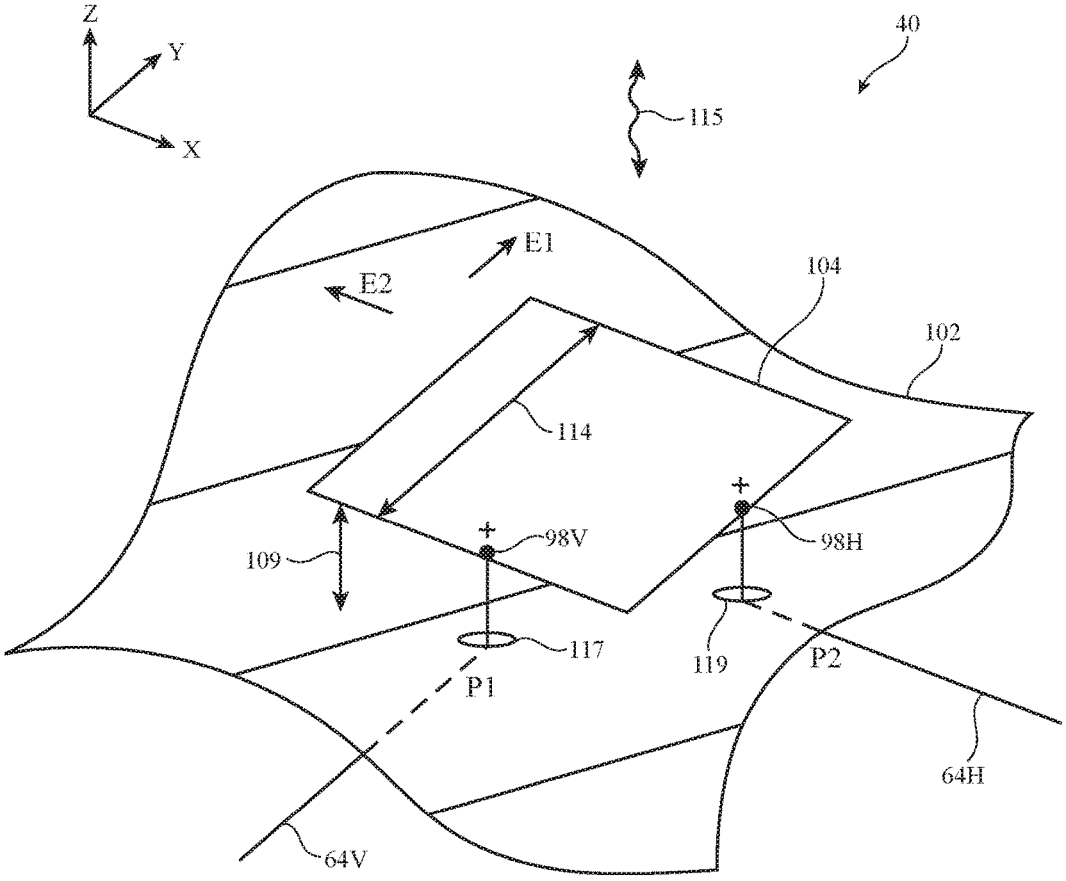
FIG. 5 is a perspective view of an illustrative patch antenna in accordance with an embodiment.

As shown in FIG. 5, antenna 40 may have a patch antenna resonating element 104 that is separated from and parallel to a ground plane such as antenna ground plane 102. Patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground plane 102 may lie within a plane that is parallel to the plane of patch element 104. Patch element 104 and ground plane 102 may therefore lie in separate parallel planes that are separated by a distance 109. Patch 104 and ground plane 102 may be formed from conductive traces patterned on a dielectric substrate such as a rigid or flexible printed circuit board substrate, metal foil, stamped sheet metal, electronic device housing structures, or any other desired conductive structures.

The length of the sides of patch element 104 may be selected so that antenna 40 resonates at a desired operating frequency. For example, the sides of patch element 104 may each have a length 114 that is approximately equal to half of the wavelength of the signals conveyed by antenna 40 (e.g., the effective wavelength given the dielectric properties of the materials surrounding patch element 104). In one suitable arrangement, length 114 may be between 0.8 mm and 1.2 mm (e.g., approximately 1.1 mm) for covering a millimeter wave frequency band between 57 GHz and 70 GHz, as just one example.

The example of FIG. 5 is merely illustrative. Patch element 104 may have a square shape in which all of the sides of patch element 104 are the same length or may have a different rectangular shape. Patch element 104 may be formed in other shapes having any desired number of straight and/or curved edges. If desired, patch element 104 and ground plane 102 may have different shapes and relative orientations.

To enhance the polarizations handled by antenna 40, antenna 40 may be provided with multiple feeds. As shown in FIG. 5, antenna 40 may have a first feed at antenna port P1 that is coupled to a first transmission line path 64 such as transmission line path 64V and a second feed at antenna port P2 that is coupled to a second transmission line path 64 such as transmission line path 64H. The first antenna feed may have a first ground antenna feed terminal coupled to ground plane 102 (not shown in FIG. 5 for the sake of clarity) and a first positive antenna feed terminal 98 such as positive antenna feed terminal 98V coupled to patch element 104. The second antenna feed may have a second ground antenna feed terminal coupled to ground plane 102 (not shown in FIG. 5 for the sake of clarity) and a second positive antenna feed terminal 98 such as positive antenna feed terminal 98H on patch element 104.

Holes or openings such as openings 117 and 119 may be formed in ground plane 102. Transmission line path 64V may include a vertical conductor (e.g., a conductive through-via, conductive pin, metal pillar, solder bump, combinations of these, or other vertical conductive interconnect structures) that extends through hole 117 to positive antenna feed terminal 98V on patch element 104. Transmission line path 64H may include a vertical conductor that extends through hole 119 to positive antenna feed terminal 98H on patch element 104. This example is merely illustrative and, if desired, other transmission line structures may be used (e.g., coaxial cable structures, stripline transmission line structures, etc.).

When using the first antenna feed associated with port P1, antenna 40 may transmit and/or receive radio-frequency signals having a first polarization (e.g., the electric field E1 of antenna signals 115 associated with port P1 may be oriented parallel to the Y-axis in FIG. 5). When using the antenna feed associated with port P2, antenna 40 may transmit and/or receive radio-frequency signals having a second polarization (e.g., the electric field E2 of antenna signals 115 associated with port P2 may be oriented parallel to the X-axis of FIG. 5 so that the polarizations associated with ports P1 and P2 are orthogonal to each other).

One of ports P1 and P2 may be used at a given time so that antenna 40 operates as a single-polarization antenna or both ports may be operated at the same time so that antenna 40 operates with other polarizations (e.g., as a dual-polarization antenna, a circularly-polarized antenna, an elliptically-polarized antenna, etc.). If desired, the active port may be changed over time so that antenna 40 can switch between covering vertical or horizontal polarizations at a given time. Ports P1 and P2 may be coupled to different phase and magnitude controllers 62 (FIG. 3) or may both be coupled to the same phase and magnitude controller 62. If desired, ports P1 and P2 may both be operated with the same phase and magnitude at a given time (e.g., when antenna 40 acts as a dual-polarization antenna). If desired, the phases and magnitudes of radio-frequency signals conveyed over ports P1 and P2 may be controlled separately and varied over time so that antenna 40 exhibits other polarizations (e.g., circular or elliptical polarizations).

If care is not taken, antennas 40 such as dual-polarization patch antennas of the type shown in FIG. 5 may have insufficient bandwidth for covering an entirety of a communications band of interest (e.g., a communications band at frequencies greater than 10 GHz). For example, in scenarios where antenna 40 is configured to cover a millimeter wave communications band between 57 GHz and 71 GHz, patch element 104 as shown in FIG. 5 may have insufficient bandwidth to cover the entirety of the frequency range between 57 GHz and 71 GHz. If desired, antenna 40 may include one or more parasitic antenna resonating elements that serve to broaden the bandwidth of antenna 40 (e.g., to extend the bandwidth of antenna 40 to cover an entirety of the communications band between 57 GHz and 71 GHz). The parasitic antenna resonating elements may include one or more conductive patches located above patch element 104, as an example.

If desired, antenna 40 of FIG. 5 may be formed on a dielectric substrate (not shown in FIG. 5 for the sake of clarity). The dielectric substrate may be, for example, a rigid or printed circuit board or other dielectric substrate. The dielectric substrate may include multiple stacked dielectric layers (e.g., multiple layers of printed circuit board substrate such as multiple layers of fiberglass-filled epoxy, multiple layers of ceramic substrate, etc.). Ground plane 102 and patch element 104 may be formed on different layers of the dielectric substrate if desired. The example of FIG. 5 is merely illustrative and, in general, antenna 40 may have any desired number of feeds. Other antenna types may be used if desired.

Figure 6:
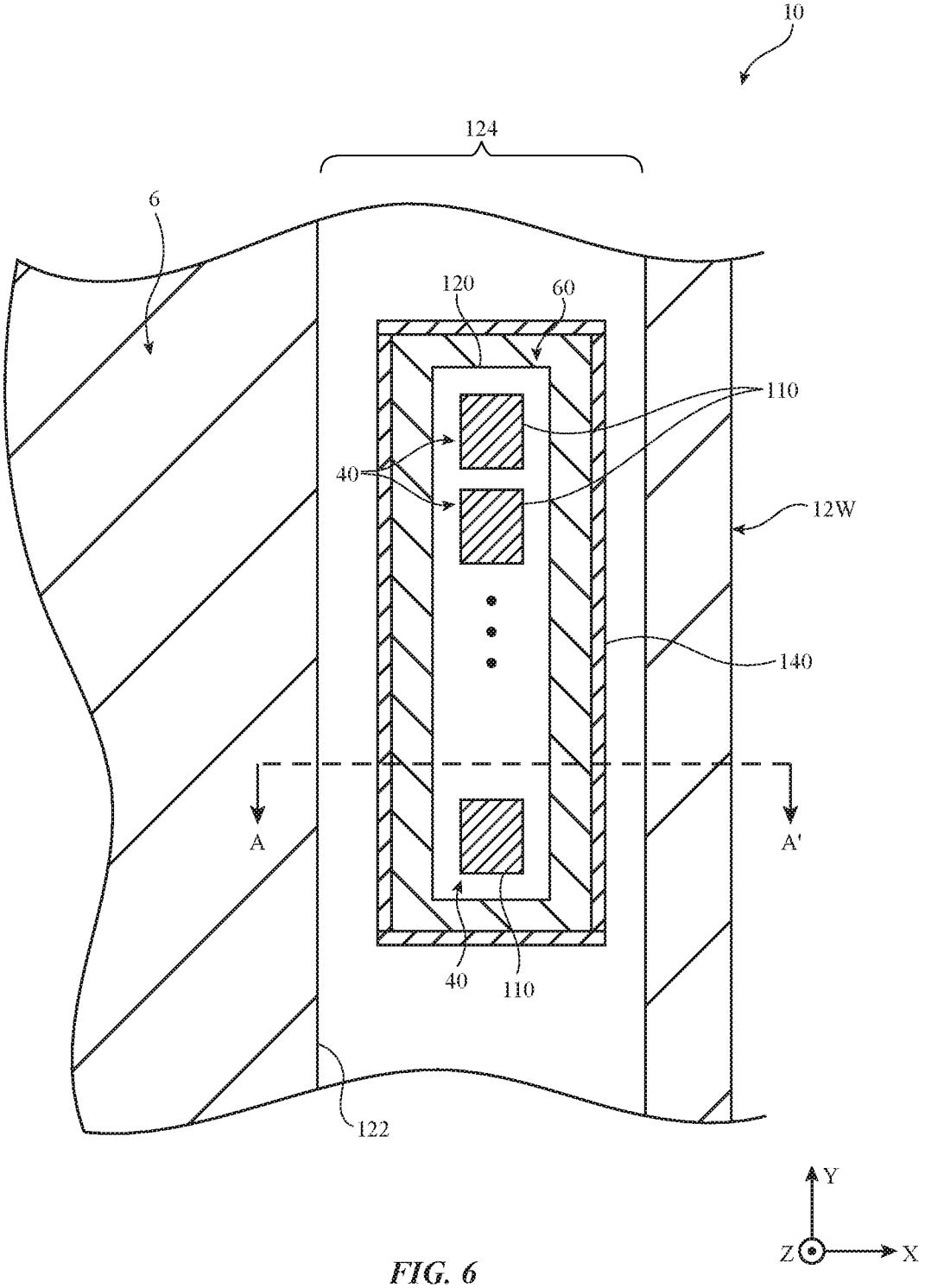
FIG. 6 is a top-down view of an illustrative electronic device having a phased antenna array mounted within a conductive shielding bucket in accordance with an embodiment.

FIG. 6 is a top-down view of electronic device 10 showing how phased antenna array 60 (FIG. 3) of antennas 40 (e.g., dual polarization patch antennas of the type shown in FIG. 5) may be mounted within device 10. The plane of the page of FIG. 6 may, for example, lie in the X-Y plane of FIG. 1.

As shown in FIG. 6, display 6 may include conductive display structures such as display structures 122. Display 6 may include a display cover layer such as a transparent glass layer (not shown in FIG. 6 for the sake of clarity) mounted over display structures 122. Display structures 122 may form active area AA of FIG. 1. Display structures 122 (sometimes referred to as display module 122, display panel 122, active display circuitry 122, or active display structures 122) may include pixels formed from light-emitting diodes (LEDs), organic LEDs (OLEDs), plasma cells, electrowetting pixels, electrophoretic pixels, liquid crystal display (LCD) components, or other suitable pixel structures. Display module 122 may include active light emitting components, touch sensor components (e.g., touch sensor electrodes), force sensor components, and/or other active components.

As shown in FIG. 6, display module 122 in display 6 may be separated from peripheral conductive housing structures 12W by gap 124 (sometimes referred to herein as opening 124 or slot 124). Gap 124 may, for example, form inactive area IA of FIG. 1 (e.g., because gap 124 is formed under the display cover layer for display 6 but is not formed under display module 122 and active area AA of display 6).

Phased antenna array 60 may be mounted within gap 124 between display module 122 and peripheral conductive housing structures 12W. Phased antenna array 60 may include any desired number of antennas 40 arranged in any desired number of rows and columns. In the example of FIG. 6, phased antenna array 60 includes a single column of antennas 40 (e.g., due to the limited lateral space between display module 122 and peripheral conductive housing structures 12W).

The antennas 40 in phased antenna array 60 may be formed on a dielectric substrate such as substrate 120. Substrate 120 may be, for example, a rigid or flexible printed circuit board or other dielectric substrate. Substrate 120 may include multiple stacked dielectric layers (e.g., multiple layers of printed circuit board substrate such as multiple layers of fiberglass-filled epoxy) or may include a single dielectric layer. Substrate 120 may include any desired dielectric materials such as epoxy, plastic, ceramic, glass, foam, or other materials. Antennas 40 in phased antenna array 60 may be mounted at a surface of substrate 120 or may be partially or completely embedded within substrate 120 (e.g., within a single layer of substrate 120 or within multiple layers of substrate 120).

In the example of FIG. 6, antennas 40 in phased antenna array 60 are shown as being patch antennas having antenna resonating elements 110 formed over an antenna ground plane (e.g., ground plane 102 of FIG. 5). Antenna resonating elements 110 may include patch elements 104 of FIG. 5 or parasitic antenna resonating elements that are parasitically coupled to the patch elements. Antenna resonating elements 110 may include other types of antenna resonating elements in scenarios where antennas 40 are implemented using other antenna structures if desired.

The ground plane, antenna resonating elements 110, and an optional parasitic element over antenna resonating elements 110 may each be formed on separate layers of substrate 120 if desired (e.g., the parasitic element or the patch element may be formed on an exposed surface of substrate 120). If desired, each antenna 40 may be fed using a single feed for covering a single polarization or may be fed using multiple feeds for covering multiple polarizations or other polarizations such as circular or elliptical polarizations (e.g., as shown in FIG. 5). This is merely illustrative and, in general, any other desired antenna structures may be used to implement antennas 40 on phased antenna array 60. Each antenna 40 in phased antenna array 60 may be laterally separated (e.g., in the X-Y plane of FIG. 6) from an adjacent antenna 40 by approximately one-half of the effective wavelength of operation of phased antenna array 60 (e.g., one-half of the freespace wavelength of operation after adjusting for contributions from the dielectric materials used to form substrate 120). Antennas having different sizes for covering multiple different frequency bands may be formed within the same phased antenna array 60 if desired.

During operation, display module 122 may generate electromagnetic signals (e.g., in displaying images and/or receiving a user input such as a touch sensor input or force sensor input). Peripheral conductive housing structures 12W may form part of another antenna in device 10 and may generate electromagnetic signals (e.g., a portion of a slot antenna resonating element, a portion of an inverted-F antenna resonating element, an antenna ground, etc.). If care is not taken, display module 122 and/or peripheral conductive housing structures 12W may electromagnetically couple to phased antenna array 60, leading to interference on the radio-frequency signals handled by phased antenna array 60.

In order to mitigate these effects, phased antenna array 60 may be mounted within a conductive shielding bucket such as conductive bucket 140. Conductive bucket 140 may include a conductive rear surface formed under phased antenna array 60 and conductive sidewalls extending around one or more peripheral sides of phased antenna array 60. Conductive bucket 140 may serve to isolate phased antenna array 60 from the electromagnetic effects of display module 122 and peripheral conductive housing structures 12W (e.g., electromagnetic coupling due to the relatively small width of gap 124 between display module 122 and peripheral conductive housing structures 122).

Figure 7:
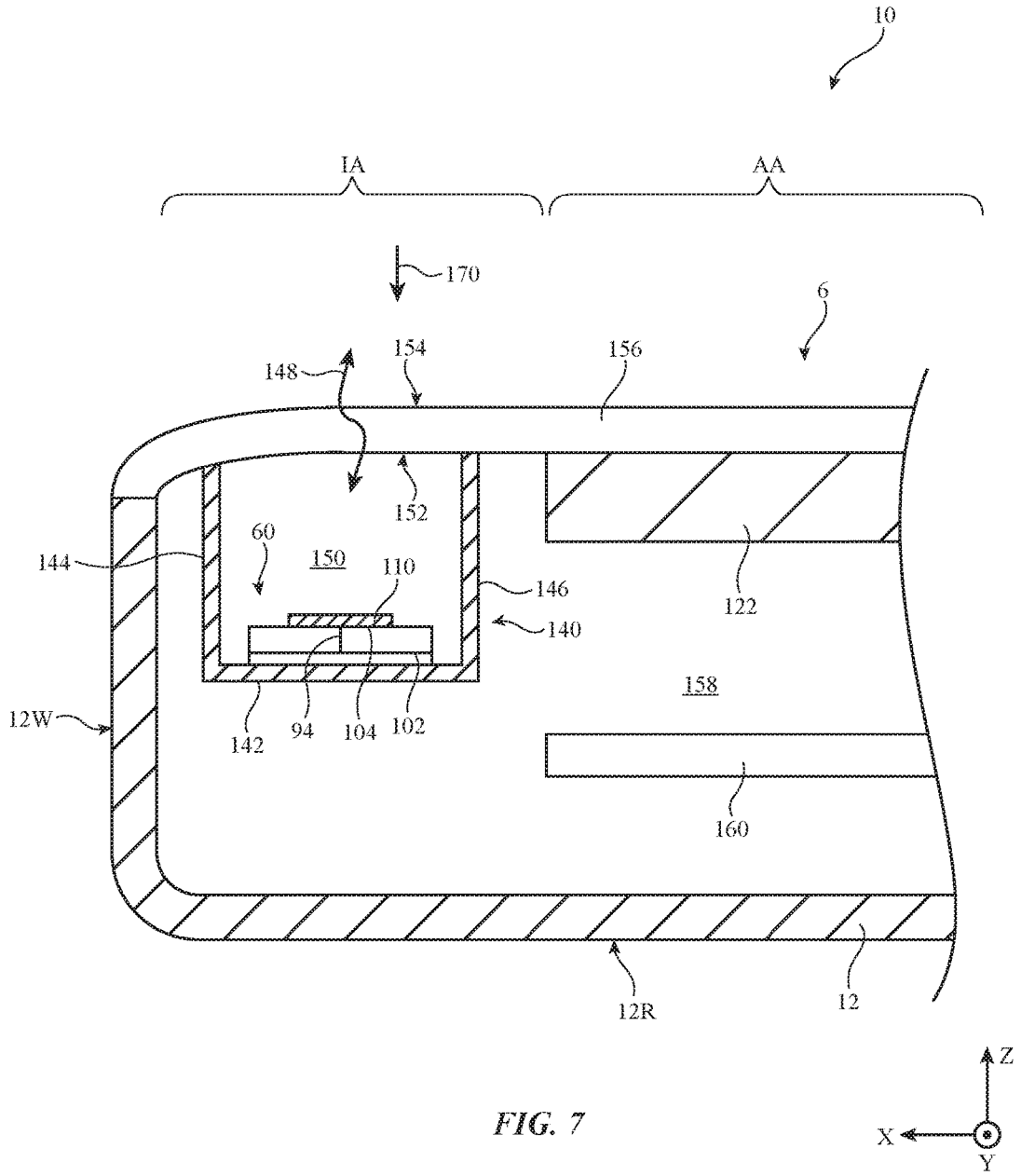
FIG. 7 is a cross-sectional side view of an illustrative electronic device having a phased antenna array mounted within a conductive shielding bucket in accordance with an embodiment.

FIG. 7 is a cross-sectional side view showing how phased antenna array 60 may be mounted to conductive bucket 140 within gap 124 (e.g., as taken along line AA' of FIG. 6). As shown in FIG. 7, display 6 may include dielectric cover layer 156 over display module 122.

Dielectric cover layer 156 (sometimes referred to herein as display cover layer 156, display cover 156, cover layer 156, or cover glass 156) may be formed from an optically transparent dielectric such as glass, sapphire, ceramic, or plastic. Display module 122 may form active area AA of display 6 and may display images (e.g., emit image light) through display cover layer 156 for view by a user and/or may gather touch or force sensor inputs through display cover layer 156. Display cover layer 156 may be used to mount display 6 to peripheral conductive housing structures 12W in one suitable arrangement. If desired, portions of display cover layer 156 may be provided with opaque masking layers (e.g., ink masking layers) and/or pigment to obscure interior 258 of device 10 from view of the user. Other components 160 such as a main logic board may be located within interior 158 of device 10. Exterior surface 154 of display cover layer 156 may form an exterior surface of device 10.

Conductive bucket 140 may be mounted below display cover layer 156 within gap 124 between peripheral conductive housing structures 12W and display module 122 (e.g., within inactive area IA of display 6). Some or all of conductive bucket 140 may be laterally interposed between peripheral conductive housing structures 12W and display module 122. Conductive bucket 140 (sometimes referred to herein as conductive shielding bucket 140, shielding bucket 140, conductive cavity 140, or conductive pocket 140) may include a conductive rear wall 142 and conductive sidewalls such as walls 144 and 146 that extend from conductive rear wall 142 towards display cover layer 156. Conductive sidewalls 144 and 146 may, for example, extend parallel to peripheral conductive housing structures 12W. Conductive rear wall 12R may extend parallel to display cover layer 156. Conductive bucket 140 may be formed using stamped sheet metal, conductive traces on underlying substrates, conductive portions of electronic components within device 10, portions of the housing for device 10, and/or any other desired conductive structures.

Phased antenna array 60 may be mounted to conductive rear wall 142 of conductive bucket 140. As shown in FIG. 7, phased antenna array 60 may include antenna resonating elements 110 (sometimes referred to herein as antenna elements 110 or antenna radiating elements 110) separated from conductive rear wall 142 by dielectric substrate 120 of phased antenna array 60. Ground plane 102 for phased antenna array 60 may be embedded within dielectric substrate 120.

If desired, ground plane 102 may be shorted to conductive bucket 140 so that conductive bucket 140 serves as a part of the antenna ground for phased antenna array 60. In another suitable arrangement, ground plane 102 within dielectric substrate 120 may be omitted and conductive bucket 140 may be held at a ground potential to serve as the antenna ground for phased antenna array 60. Transmission line signal conductors 94 may coupling antenna resonating elements 110 to transceiver circuitry. Transmission line signal conductors 94 may, for example, include conductive through vias extending through substrate 120. Holes or openings may be formed in conductive bucket 140 to allow transmission line structures (e.g., transmission line paths 64 of FIG. 5) to be routed between phased antenna array 60 and the transceiver circuitry.

The example of FIG. 7 in which conductive bucket 140 and phased antenna array 60 is mounted behind display cover layer 156 is merely illustrative. If desired, conductive bucket 140 and phased antenna array 60 may be mounted behind any desired dielectric layer located at any desired location on device 10 (e.g., where display cover layer 156 of FIG. 7 is replaced with a dielectric housing wall or an antenna window in a conductive housing wall located elsewhere on device 10 such as rear housing wall 12R).

As shown in FIG. 7, display cover layer 156 may be separated from phased antenna array 60 by a gap such as gap 150 (sometimes referred to herein as cavity 150, dielectric cavity 150, or volume 150). Cavity 150 may be filled with a dielectric material such as plastic, foam, air, etc. The dielectric properties of cavity 150 and display cover layer 156 may be selected to impedance match phased antenna array 60 to the exterior of device 10. Display cover layer 156 may have a uniform thickness (as defined by the distance between interior surface 152 and exterior surface 154 of display cover layer 156) across the lateral area of phased antenna array 60 or may have a varying thickness across the lateral area of phased antenna array 60. Interior surface 152 may sometimes be referred to herein as internal surface 152, inner surface 152, or lower surface 152. Exterior surface 154 may sometimes be referred to herein as external surface 154, outer surface 154, or upper surface 154.

Surfaces 152 and 154 may lie in parallel planes with respect to a surface of antenna resonating elements 110, a surface of substrate 120, and/or a surface of ground plane 102. In another suitable example, interior surface 152 and/or exterior surface 154 may be curved to minimize destructive interference between radio-frequency signals that are transmitted by phased antenna array 60 and reflected versions of the transmitted signals that are reflected at surfaces 152 and/or 154 (e.g., due differences in the dielectric constants of cavity 150, display cover layer 156, and the exterior of device 10).

Conductive sidewalls such as sidewalls 144 and 146 may extend around all sides of cavity 150 (e.g., to surround the lateral periphery of phased antenna array 60). In this way, conductive bucket 140 and display cover layer 156 may completely enclose or encapsulate phased antenna array 60 within cavity 150 (e.g., the edges of cavity 150 may be defined by conductive bucket 140 and display cover layer 156).

Conductive bucket 140 may be affixed, attached, or connected to dielectric cover layer 122. For example, conductive bucket 140 may be in direct contact with interior surface 152 of display cover layer 156 (e.g., conductive bucket 140 may be secured to display cover layer 156 using screws, pins, clips, or other fastening structures) or may be secured to display cover layer 156 using adhesive (e.g., a layer of conductive and/or dielectric adhesive interposed between the top surface of sidewalls 144 and 146 and interior surface 152 of display cover layer 156). In another suitable arrangement, conductive bucket 140 may be unattached to display cover layer 156. For example, conductive bucket 140 may be pressed against interior surface 152 of display cover layer 156 using biasing structures (e.g., springs, foam, clips, magnets, etc.) or may be separated from interior surface 152 by a gap.

Conductive bucket 140 may serve to block electromagnetic signals conveyed by phased antenna array 60 from escaping cavity 150 towards the interior of device 10. Similarly, conductive bucket 140 may serve to block electromagnetic interference at phased antenna array due to peripheral conductive housing structures 12W (e.g., other antenna structures in device 10) and/or display module 122. Conductive bucket 140 may also serve to block surface waves generated at interior surface 152 within cavity 150 from propagating beyond cavity 150.

In this way, phased antenna array 60 may be mounted within a relatively small inactive area IA of display 6 (thereby allowing for as large an active area AA for a user of device 10 as possible), without allowing the relatively high electromagnetic coupling associated with such a small volume between active circuitry (e.g., display module 122) and antenna components (e.g., peripheral conductive housing structures 12W) to interfere with the operation of phased antenna array 60 at millimeter and centimeter wave frequencies. The example of FIG. 7 is merely illustrative. If desired, conductive bucket 140 may have other shapes (e.g., shapes having straight and/or curved edges or walls).

Figure 8:
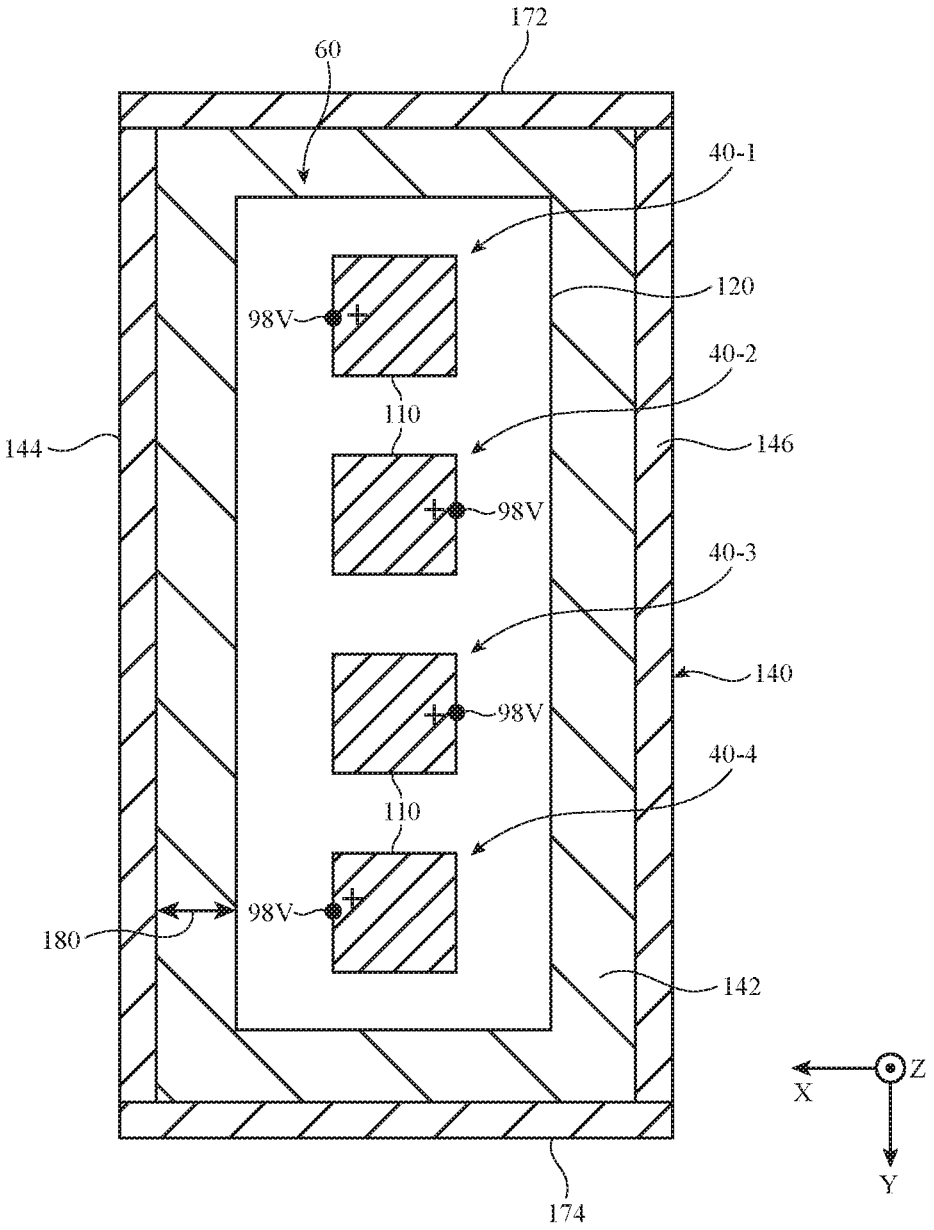
FIG. 8 is a top-down view of an illustrative phased antenna array mounted within a conductive shielding bucket and having alternating antenna feed terminals to minimize antenna cross-coupling in accordance with an embodiment.

In practice, if care is not taken, electromagnetic cross-coupling between antennas 40 within phased antenna array 60 can limit the overall antenna efficiency for phased antenna array 60. If desired, antennas 40 within phased antenna array 60 may be provided alternating feed locations to minimize cross-coupling between antennas 40. FIG. 8 is a top-down view of phased antenna array 60 having alternating feed locations within conductive bucket 140.

As shown in FIG. 8, substrate 120 of phased antenna array 60 may be mounted to conductive rear wall 142 of conductive bucket 140. Conductive bucket 140 may include sidewalls such as sidewalls 144, 146, 172, and 174 that laterally surround the periphery of cavity 150 and phased antenna array 60.

Phased antenna array 60 may include four antennas 40 such as a first antenna 40-1, a second antenna 40-2, a third antenna 40-3, and a fourth antenna 40-4. Antennas 40-1, 40-2, 40-3, and 40-4 may each handle radio-frequency signals of a given polarization (e.g., a vertical polarization) using corresponding vertical positive antenna feed terminals 98V. In order to minimize cross-coupling between the vertical feeds of antennas 40, positive antenna feed terminals 98V of antennas 40-1 and 40-4 may be coupled to the corresponding antenna resonating elements 110 adjacent to conductive sidewall 144 whereas positive antenna feed terminals 98V of antennas 40-2 and 40-3 are coupled to the corresponding antenna resonating elements 110 adjacent to conductive sidewall 146. In other words, positive antenna feed terminals 98V of antennas 40-1 and 40-4 may be coupled to the side of the corresponding antenna resonating elements 110 facing conductive sidewall 144. Positive antenna feed terminals 98V of antennas 40-2 and 40-3 may be coupled to the side of the corresponding antenna resonating elements 110 facing conductive sidewall 146.

Radio-frequency signals handled by positive antenna feed terminal 98V of antenna 40-1 may be approximately 180 degrees out of phase with the radio-frequency signals handled by positive antenna feed terminal 98V of antenna 40-2. Similarly, radio-frequency signals handled by positive antenna feed terminal 98V of antenna 40-3 may be approximately 180 degrees out of phase with the radio-frequency signals handled by positive antenna feed terminal 98V of antenna 40-4. This may serve to minimize cross-coupling between antennas 40-1, 40-2, 40-3, and 40-4 in phased antenna array 60 and thus maximize antenna efficiency for phased antenna array 60. While the example of FIG. 8 shows four antennas 40 in phased antenna array 60, a similar feeding arrangement may be used for any desired number of antennas (e.g., where each pair of adjacent antennas has alternating vertical antenna feed locations).

In another suitable arrangement, the positive antenna feed terminal 98V for each of antennas 40-1, 40-2, 40-3, and 40-4 may be located on the same side of phased antenna array 60. For example, the positive antenna feed terminal 98V for each of antennas 40-1, 40-2, 40-3, and 40-4 may be located on the side of antenna resonating elements 110 facing conductive sidewall 146. This may, for example, maximize the distance between the antenna feed terminals and peripheral conductive housing structures 12W and thus maximize isolation between phased antenna array 60 and peripheral conductive housing structures 12W (e.g., in scenarios where peripheral conductive housing structures 12W form part of another antenna in device 10). In general, the location of positive antenna feed terminals 98V may be selected to maximize isolation between phased antenna array 60 and peripheral conductive housing structures 12W, to maximize isolation between phased antenna array 60 and display module 122, and/or to minimize cross coupling between the antennas in phased antenna array 60 at desired frequencies.

Substrate 120 and/or antenna resonating elements 110 may be separated from the conductive sidewalls of conductive bucket 140 by a gap 180. The size of gap 180 may be adjusted to tweak a capacitance of phased antenna array 60 (e.g., to help impedance match phased antenna array 60 to display cover layer 156 of FIG. 7 and to optimize antenna efficiency for phased antenna array 60). Gap 180 may be omitted if desired.

The example of FIG. 8 is merely illustrative. Phased antenna array 60 may include any desired number of antennas 40 arranged in any desired pattern and having any desired feed locations. Phased antenna array 60 may include different antennas (e.g., patch antennas having patch elements with different sizes) for concurrently covering different frequencies. Conductive sidewalls 172 and/or 174 may be omitted if desired. Conductive bucket 140 and/or substrate 120 may have other shapes (e.g., shapes having curved and/or straight edges). Conductive sidewalls 144, 172, 146, and/or 174 may be omitted and the conductive boundary of cavity 150 may be defined by other conductive components within device 10 if desired.

Figure 9:
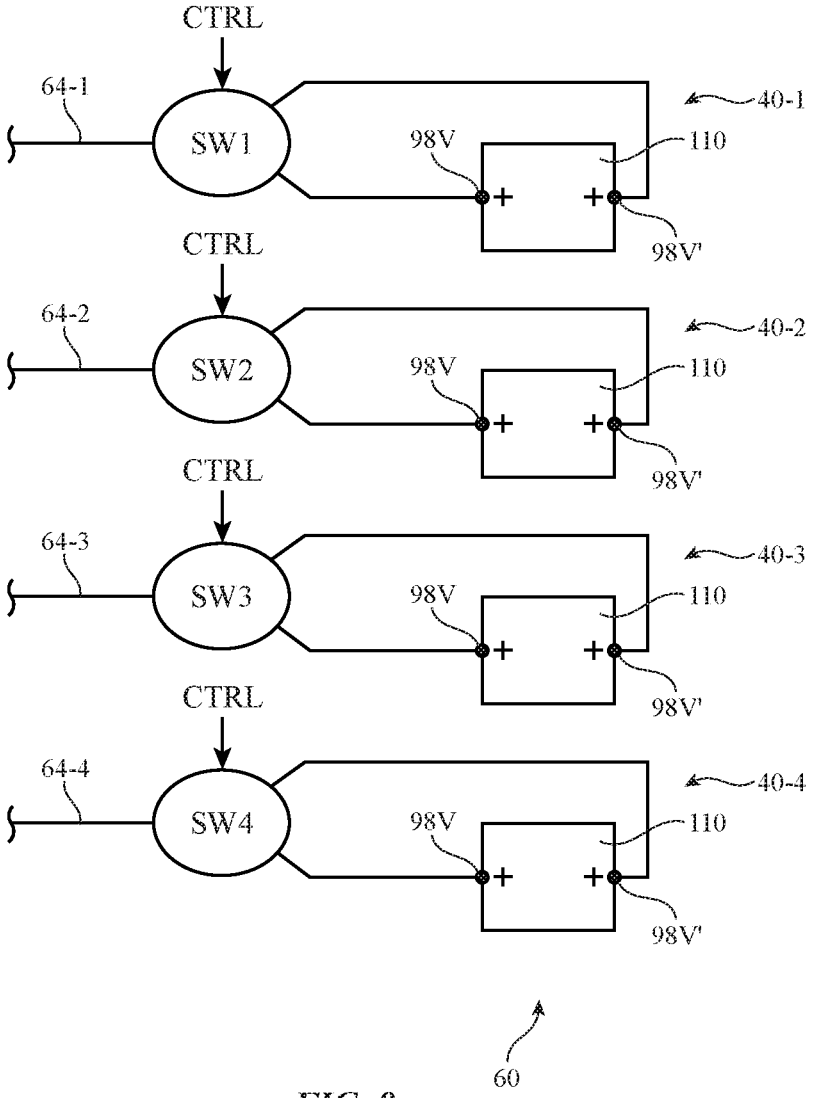
FIG. 9 is a schematic diagram showing how an illustrative phased antenna array may include antennas with multiple switchable antenna feed terminals in accordance with an embodiment.

If desired, each antenna 40 in phased antenna array 60 may include multiple positive antenna feed terminals that can be selectively activated or deactivated at any given time. FIG. 9 is a schematic circuit diagram showing how antennas 40 in phased antenna array 60 may have switchable antenna feed terminals.

As shown in FIG. 9, antennas 40-1, 40-2, 40-3, and 40-4 of phased antenna array 60 may include multiple vertical positive antenna feed terminals such as a first positive antenna feed terminal 98V and a second vertical positive antenna feed terminal 98V'. Positive antenna feed terminals 98V and 98V' may, for example, be coupled to opposing sides of the corresponding antenna resonating element 110.

Positive antenna feed terminals 98V and 98V' may each be coupled to a corresponding switch. For example, positive antenna feed terminals 98V and 98V' of antenna 40-1 may be coupled to switch SW1, positive antenna feed terminals 98V and 98V' of antenna 40-2 may be coupled to switch SW2, positive antenna feed terminals 98V and 98V' of antenna 40-3 may be coupled to switch SW3, etc. Each switch may be coupled to transceiver circuitry 28 (FIG. 2) over a corresponding radio-frequency transmission line path 64. For example, switch SW1 may be coupled to the transceiver circuitry over radio-frequency transmission line path 64-1, switch SW2 may be coupled to the transceiver circuitry over radio-frequency transmission line path 64-2, switch SW3 may be coupled to the transceiver circuitry over radio-frequency transmission line path 64-3, etc. The switches may receive a control signal CTRL from control circuitry 14 (FIG. 2). Control signal CTRL may control the switches to activate a selected one of positive antenna feed terminals 98V and 98V' for use at any given time for each antenna 40 (e.g., the positive antenna feed terminals may be activated by coupling the terminals to the corresponding radio-frequency transmission line path 64 and may be deactivated by decoupling the terminals from the radio-frequency transmission line path).

In this way, control circuitry 14 may actively control phased antenna array 60 to use a different selected positive antenna feed terminal for each antenna 40 in phased antenna array 60 at a given time. Control circuitry 14 may monitor the wireless performance of phased antenna array 60 (e.g., by gathering radio-frequency performance metric data such as error level data, received signal strength data, etc.), software operations that are being performed by device 10, and/or sensor data gathered by device 10 to determine which positive antenna feed terminals to activate (use) at a given time (e.g., a set of positive antenna feed terminals that maximizes antenna efficiency for phased antenna array 60 at a given time). The active positive antenna feed terminals may be changed over time as environmental and/or operating conditions of device 10 change over time (e.g., to ensure that phased antenna array 60 continues to exhibit satisfactory wireless performance over time).

The example of FIG. 9 is merely illustrative. If desired, each antenna 40 may also include one or more horizontal positive antenna feed terminals (e.g., horizontal positive antenna feed terminals 98H of FIG. 5). In scenarios where each antenna 40 includes multiple horizontal positive antenna feed terminals, control circuitry 14 may control the switching circuitry to selectively activate one or more of the horizontal positive antenna feed terminals at a given time (e.g., to optimize wireless performance for phased antenna array 60). More than two vertical positive antenna feed terminals and/or more than two horizontal positive antenna feed terminals may be used for each antenna if desired. Antenna resonating elements 110 may have any desired shape. Any desired number of antennas 40 may be formed in phased antenna array 60. Any desired switching circuitry may be used to selectively couple different positive antenna feed terminals to radio-frequency transmission line paths 64 (e.g., any desired network of switches, switch matrices, etc.).

In practice, the presence of display cover layer 156 (FIG. 7) over phased antenna array 60 may undesirably load phased antenna array 60. If care is not taken, this loading can detune phased antenna array 60 or otherwise reduce the wireless performance of phased antenna array 60. If desired, conductive bucket 140 may be provided with additional dielectric layers to help to mitigate these loading effects.

Figure 10:
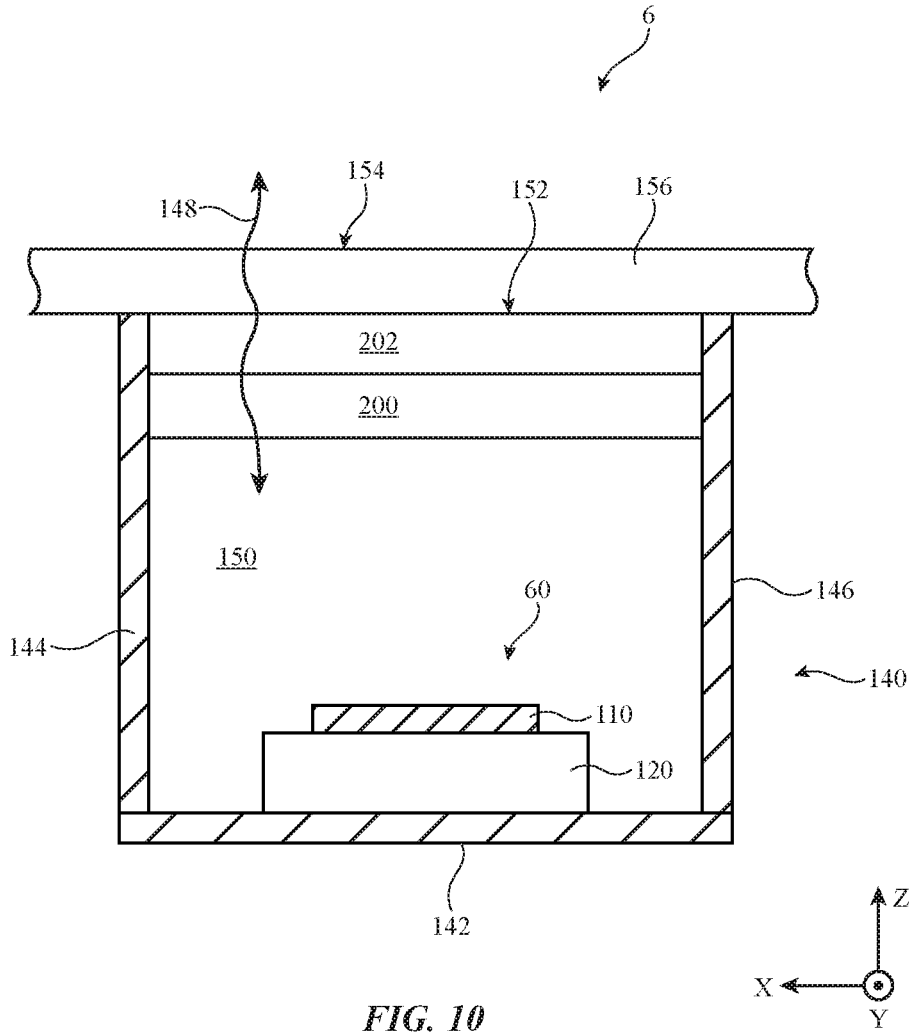
FIG. 10 is a cross-sectional side view of an illustrative phased antenna array provided with dielectric layers for impedance matching the phased antenna array to a dielectric cover layer in accordance with an embodiment.

FIG. 10 is a cross-sectional side view of conductive bucket 140 having additional dielectric layers to mitigate the loading effects of display cover layer 156. As shown in FIG. 10, additional dielectric layers such as dielectric layers 200 and 202 may be interposed between phased antenna array 60 and display cover layer 156. Dielectric layers 200 and 202 may be formed within cavity 150 (e.g., conductive sidewalls 144 and 146 may surround layers 200 and 202). In another suitable arrangement, dielectric layers 200 and 202 may be formed on interior surface 152 of display cover layer 156 and conductive sidewalls 144 and 146 may be mounted to dielectric layers 200 and 202 (e.g., dielectric layers 200 and 202 may be interposed between display cover layer 156 and conductive sidewalls 144 and 146).

Dielectric layers 202 and 204 may be formed from any desired dielectric materials (e.g., glass, plastic, ceramic, polymer, etc.). Display cover layer 156 may have a first dielectric constant (e.g., 6.0). Dielectric layer 202 may have a second dielectric constant that is less than the first dielectric constant (e.g., 4.0). Dielectric layer 200 may have a third dielectric constant that is less than the second dielectric constant (e.g., 3.0). Graduating the dielectric constant between phased antenna array 60 and display cover layer 156 in this way (e.g., using interposing dielectric layers of intermediate dielectric constant such as layers 202 and 204), may serve to reduce the loading effects of display cover layer 156 on phased antenna array 60, thereby maximizing the antenna efficiency of phased antenna array 60, for example.

The example of FIG. 10 is merely illustrative. If desired, layer 200 may be omitted or more than two dielectric layers may be interposed between cavity 150 and display cover layer 156. If desired, the shape and/or size of antenna resonating elements 110 may be adjusted to help to compensate for dielectric loading effects of display cover layer 156. The size of gap 180 of FIG. 8 may also be adjusted to compensate for these effects if desired. More than one phased antenna array 60 may be formed within conductive bucket 140 if desired.

Figure 11:
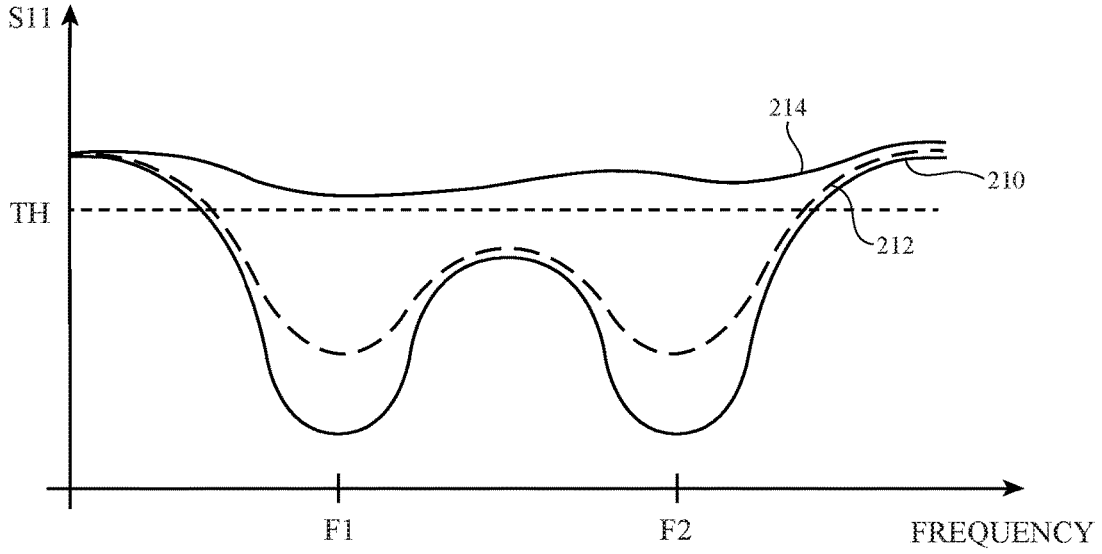
FIGS. 11 and 12 are graphs of illustrative antenna performance (SI 1 reflection coefficient values) as a function of frequency for a phased antenna array of the type shown in FIGS. 6-10 in accordance with an embodiment.

FIG. 11 shows a plot of antenna performance (e.g., a scattering parameter such as reflection coefficient S11) as a function of frequency for phased antenna array 60. As shown in FIG. 10, curve 210 illustrates the performance of phased antenna array 60 located in a free space environment. As shown by curve 210, phased antenna array 60 may exhibit performance peaks at one or more frequencies such as frequency F1 and frequency F2 (e.g., frequencies at which reflection coefficient S11 is at a minimum and thus antenna efficiency is at a maximum). Frequencies F1 and F2 may be any desired frequencies between 10 GHz and 300 GHz. In one suitable arrangement, frequency F1 may be approximately 38 GHz whereas frequency F2 is approximately 42 GHz. Phased antenna array 60 may exhibit satisfactory wireless performance (e.g., reflection coefficient values below predetermined threshold level TH) across a frequency band that includes frequencies F1 and F2 (e.g., a frequency band extending from about 37 GHz to about 43 GHz).

Curve 214 illustrates the performance of phased antenna array 60 when located within gap 124 between peripheral conductive housing structures 12W and display module 122 (FIGS. 6 and 7) and in the absence of conductive bucket 140. As shown by curve 214, phased antenna array 60 may exhibit unsatisfactory wireless performance (e.g., reflection coefficient values that exceed predetermined threshold level TH) across the frequency band. This reduction in antenna performance may, for example, be a result of interference between peripheral conductive housing structures 12W and phased antenna array 60, interference between display module 122 and phased antenna array 60, and/or cross coupling between antennas 40 in phased antenna array 60.

Curve 212 illustrates the performance of phased antenna array 60 when mounted within conductive bucket 140. As shown by curve 212, phased antenna array 60 may exhibit satisfactory wireless performance across the frequency band. This increase in antenna performance may be a result of the isolation provided by conductive bucket 140, the use of alternating antenna feed terminals (e.g., as shown in FIG. 8), the use of switchable feed terminals (e.g., as shown in FIG. 9), and/or the use of intervening dielectric layers within conductive bucket 140 (e.g., as shown in FIG. 10), for example. In this way, phased antenna array 60 may continue to operate with satisfactory antenna efficiency across a desired frequency band despite the relatively small available volume within inactive area IA of display 6 (FIG. 7).

Figure 12:
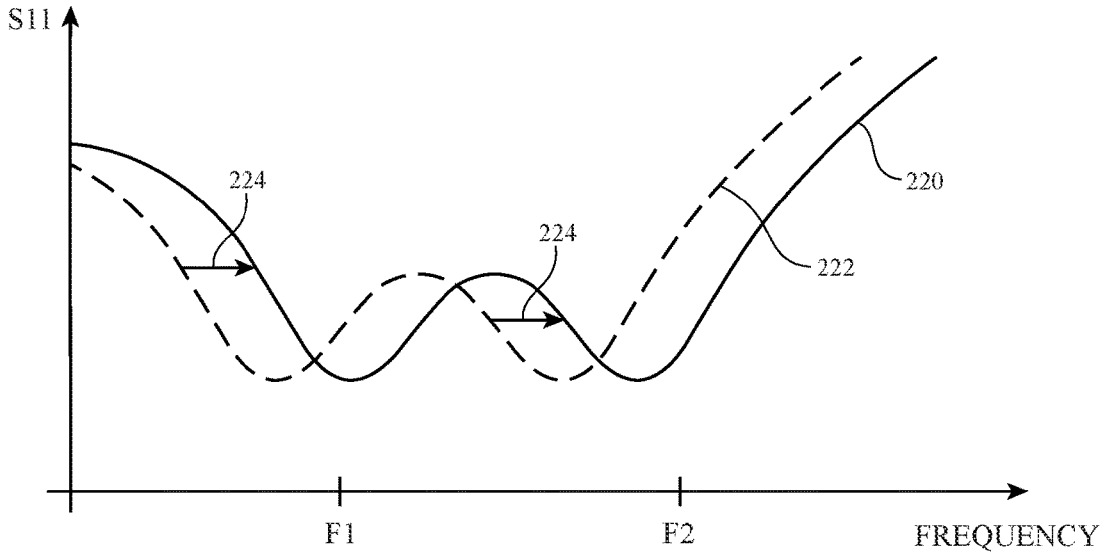

FIG. 12 is a plot of reflection coefficient S11 as a function of frequency for phased antenna array 60 illustrating how phased antenna array 60 may mitigate dielectric loading effects from display cover layer 156. As shown in FIG. 12, curve 222 illustrates the performance of phased antenna array 60 when loaded by display cover layer 156. As shown by curve 222, the presence of display cover layer 156 may detune the response of phased antenna array 60 to lower frequencies. This detuning may reduce the overall antenna efficiency of phased antenna array 60 across the entire frequency band of interest.

Forming dielectric layers such as dielectric layers 200 and 202 (FIG. 10) between phased antenna array 60 and display cover layer 156 may mitigate the dielectric loading effects of display cover layer 156, shifting the response of phased antenna array 60 to a response illustrated by curve 220, as shown by arrow 224. Shift 224 may also be produced by adjusting the shape of antenna resonating elements 110 (FIG. 8) if desired. For example, antenna resonating elements 110 may be reduced in size so that length 114 (FIG. 5) is less than half of the wavelength of operation, thereby counteracting the shift to lower frequencies generated by display cover layer 156. Combinations of these arrangements may be used to produce shift 224 if desired. In this way, the frequency response of phased antenna array 60 may be re-aligned with the frequency band of interest despite loading effects from display cover layer 156 (e.g., so that phased antenna array 60 exhibits satisfactory antenna efficiency over the entire frequency band of interest).

The examples of FIGS. 11 and 12 are merely illustrative. Phased antenna array 60 may exhibit any desired number of wireless performance peaks at any desired number of frequencies greater than 10 GHz. In general, curves 212 (FIG. 11), 222, and 220 (FIG. 12) may exhibit other shapes. In this way, phased antenna array 60 may operate with satisfactory antenna efficiency at millimeter and centimeter wave frequencies despite the small amount of space within device 10 available for phased antenna array 60, electromagnetic interference generated by peripheral conductive housing structures 12W and display module 122, and dielectric loading effects from display cover layer 156.

The foregoing is merely illustrative and various modifications can be made to the described embodiments. The foregoing embodiments may be implemented individually or in any combination.

What is claimed is:

1. An electronic device, comprising:

a housing having a peripheral conductive sidewall;

a display having a display cover layer mounted to the peripheral conductive sidewall and a display module configured to emit light through the display cover layer, wherein the display module is separated from the conductive sidewall by a gap;

a conductive bucket mounted within the gap between the display module and the peripheral conductive sidewall, the conductive bucket and the display cover layer defining a cavity;

transceiver circuitry configured to generate radio-frequency signals at a frequency between 10 GHz and 300 GHz; and a phased antenna array mounted to the conductive bucket within the cavity, wherein the phased antenna array is configured to transmit the radio-frequency signals through the display cover layer.

2. The electronic device defined in claim 1, further comprising:

additional transceiver circuitry configured to generate additional radio-frequency signals at an additional frequency between 600 MHz and 10 GHz; and an antenna that includes the peripheral conductive sidewall and that is configured to transmit the additional radio-frequency signals.

3. The electronic device defined in claim 2, wherein the conductive bucket comprises a conductive rear wall and conductive sidewalls extending from the conductive rear wall to the display cover layer, the phased antenna array being mounted to the conductive rear wall.

4. The electronic device defined in claim 3, wherein the phased antenna array comprises a plurality of patch antenna resonating elements on a substrate, each of the patch antenna resonating elements in the plurality of patch antenna resonating elements being fed by first and second positive antenna feed terminals.

5. The electronic device defined in claim 4, wherein the first and second positive antenna feed terminals are configured to convey the radio-frequency signals at respective first and second orthogonal polarizations.

6. The electronic device defined in claim 5, wherein each of the patch antenna resonating elements in the plurality of patch antenna resonating elements has a first side facing the peripheral conductive sidewall and an opposing second side facing the display module, the first positive antenna feed terminal for each of the patch antenna resonating elements in the plurality of patch antenna resonating elements being located at the second side of the patch antenna resonating element in the plurality of patch antenna resonating elements.

7. The electronic device defined in claim 5, further comprising:

a dielectric layer on an interior surface of the display cover layer and within the cavity, wherein the display cover layer has a first dielectric constant and the dielectric layer has a second dielectric constant that is less than the first dielectric constant.

8. The electronic device defined in claim 4, wherein the first and second positive antenna feed terminals are both configured to convey the radio-frequency signals using parallel linear polarizations.

9. The electronic device defined in claim 8, further comprising:

switching circuitry coupled to the first and second positive antenna feed terminals for each of the patch antenna resonating elements in the plurality of patch antenna resonating elements; and control circuitry coupled to the switching circuitry and configured to control the switching circuitry to activate a selected one of the first and second positive antenna feed terminals for each of the patch antenna resonating elements in the plurality of patch antenna resonating elements at a given time.

10. The electronic device defined in claim 3, wherein the antenna comprises an antenna ground, the peripheral conductive sidewall forming a portion of the antenna ground.

11. The electronic device defined in claim 3, wherein the antenna comprises an antenna resonating element and an antenna ground, the peripheral conductive sidewall forming a portion of the antenna resonating element.

12. An electronic device comprising:

a housing having a dielectric wall;

a conductive cavity mounted in the housing, wherein the conductive cavity has a conductive rear wall and conductive sidewalls extending from a periphery of the conductive rear wall to the dielectric wall;

a phased antenna array mounted to the conductive rear wall and configured to convey radio-frequency signals at a frequency greater than 10 GHz through the dielectric wall; and a dielectric layer on an interior surface of the dielectric wall, wherein the dielectric wall has a first dielectric constant and the dielectric layer has a second dielectric constant that is less than the first dielectric constant.

13. The electronic device defined in claim 12, further comprising:

an additional dielectric layer on the dielectric layer, wherein the dielectric layer is interposed between the interior surface of the dielectric wall and the additional dielectric layer, and the additional dielectric layer has a third dielectric constant that is less than the second dielectric constant.

14. The electronic device defined in claim 13, wherein the conductive sidewalls laterally surround the dielectric layer and the additional dielectric layer.

15. The electronic device defined in claim 12, further comprising:

a display having a display cover layer that forms a front face of the electronic device, wherein the dielectric wall forms a rear face of the electronic device.

16. The electronic device defined in claim 15, wherein the dielectric wall comprises glass and the conductive sidewalls are in direct contact with the dielectric layer.

17. An electronic device comprising:

a dielectric cover layer;

a conductive bucket having a conductive rear wall and first and second conductive sidewalls extending from opposing sides of the conductive rear wall to the dielectric cover layer; and a phased antenna array mounted to the conductive rear wall and configured to transmit radio-frequency signals at a frequency between 10 GHz and 300 GHz through the dielectric cover layer, the phased antenna array comprising:

a substrate mounted to the conductive rear wall, a first antenna resonating element on the substrate, wherein the first antenna resonating element has a first side facing the first conductive sidewall and a second side facing the second conductive sidewall, a second antenna resonating element on the substrate, wherein the second antenna resonating element has a first side facing the first conductive sidewall and a second side facing the second conductive sidewall, a first positive antenna feed terminal coupled to the first side of the first antenna resonating element, and a second positive antenna feed terminal coupled to the second side of the second antenna resonating element.

18. The electronic device defined in claim 17, wherein the phased antenna array further comprises:

a third antenna resonating element on the substrate, wherein the third antenna resonating element has a first side facing the first conductive sidewall and a second side facing the second conductive sidewall;

a fourth antenna resonating element on the substrate, wherein the fourth antenna resonating element has a first side facing the first conductive sidewall and a second side facing the second conductive sidewall, the second antenna resonating element being interposed between the first and third antenna resonating elements, and the third antenna resonating element being interposed between the second and fourth antenna resonating elements;

a third positive antenna feed terminal coupled to the second side of the third antenna resonating element, and a fourth positive antenna feed terminal coupled to the first side of the fourth antenna resonating element.

19. The electronic device defined in claim 18, further comprising:

a housing having a peripheral conductive sidewall, wherein the dielectric cover layer is mounted to the peripheral conductive sidewall;

a display having a display module, wherein the dielectric cover layer is mounted to the display module, the display module is configured to emit light through the dielectric cover layer, the display module is separated from the peripheral conductive sidewall by a gap, and the conductive bucket is mounted to the dielectric cover layer within the gap.

20. The electronic device defined in claim 19, wherein the first conductive sidewall of the conductive bucket is interposed between the phased antenna array and the peripheral conductive sidewall and the second conductive sidewall of the conductive bucket is interposed between the phased antenna array and the display module.

* * * * *